United States Patent [19]

Melek

[11] Patent Number: 4,555,639

[45] Date of Patent: Nov. 26, 1985

[54] MONEY-OPERATED UNIT CONTROL SYSTEM

[76] Inventor: Bernard Melek, 92 Dunthorne Ct., Scarborough, Ontario, Canada, M1B 2S9

[21] Appl. No.: 625,775

[22] Filed: Jun. 28, 1984

[51] Int. Cl.[4] ..... G07F 13/00; G07F 5/18

[52] U.S. Cl. ..... 307/38; 307/113; 194/5; 194/13

[58] Field of Search ..... 194/1 A, 1 B, 5, 9 T, 194/10, 13; 307/38, 39, 112, 115

[56] References Cited

U.S. PATENT DOCUMENTS 3,066,245 11/1962 Baker et al. ..... 307/38

3,587,808 6/1971 Romanowski ..... 194/13

3,921,854 11/1975 Formica et al. ..... 194/13 X

*Primary Examiner*—A. D. Pellinen

*Assistant Examiner*—T. DeBoer

*Attorney, Agent, or Firm*—George A. Rolston

[57] ABSTRACT

A money operated control is used to control and operate a selected one of a plurality of electrical units such as washing, drying or gas dispensing machines. Each such unit includes a unit controller device operable to control the functioning of the unit upon delivery of a start signal to the unit controller device. The start signal is generated by actuating a select switch which corresponds to the desired machine. Each select switch is defined by two normally closed switches which are ganged together with a normally open switch.

5 Claims, 4 Drawing Figures

MONEY-OPERATED UNIT CONTROL SYSTEM

NATURE OF THE INVENTION

The invention relates to a central control device for controlling the selection and operation of a multiplicity of electrical units. In particular, the invention relates to a central control device which may be activated by coins or bills.

BACKGROUND OF THE INVENTION

In many situations, numerous electrical or electronic machines, or units, are available to a user to perform a particular task. For instance, in a laundromat, individual washing machines and drying machines are available for the use of the customer. Typically, each individual unit is provided with its own control system and control panel. Each such unit is independent of each other unit. For general consumer use, a control system and panel will usually include a money acceptor device as well as an actual controller or timer device for the unit. Coin acceptor devices are common such money acceptor devices. However, bill acceptor devices are also known. Either of such money acceptor devices may be used. However, in this specification for ease of description, reference is made only to coin acceptor devices.

To operate a particular unit, coins are inserted into holes or slots provided on the control panel of that unit. The coins pass into the coin acceptor device. If an adequate number of coins are inserted, an electrical signal is passed by the coin acceptor to the controller and the unit is enabled for use. When ready, the customer can start the machine by pushing a button, closing a lid, or performing some other similar task. Some coin acceptor devices may provide change, if an excess amount of money is inserted. Some devices may also provide a coin return mechanism, for use in the event that the customer decides not to use the unit after coins have already been inserted.

In some electrical units, such as a washing machine, a simplified coin acceptor device, generally known as a coin slider, is provided, however its basic functions are the same as described above.

In the typical consumer distribution center, such as a laundromat, the distribution system merely comprises of a number of units placed around a store for use by the consumer. In such a system, a consumer selects a machine by inspecting each machine until he finds a suitable available machine. A machine is available if it is in working order and not in use by another person. The machine is loaded with clothes, or otherwise prepared for use, and coins inserted.

Such a system has several disadvantages. First, the customer is inconvenienced by having to walk around to inspect the various machines in order to select one for use. Second, a large number of expensive coin acceptors is required—one for each machine—which adds significantly to the overall cost of the system. Third, with a large number of coin acceptors there is an increased probability that one or more of such coin acceptors will be out-of-order at any given time. Fourth, maintenance requirements are increased because of the increased number of coin acceptors. Fifth, it may not be possible to provide change because of the expense of purchasing and installing individual change-providing acceptors on each machine.

One solution for avoiding the above disadvantages is to provide a centralized control area, where a human operator may accept payment for use of the machines and control the operation of the machines. The disadvantage, however, with such a solution is that a human operator is required with attendant costs.

In light of all the foregoing disadvantages, it would clearly be advantageous to provide a centralized, automatic coin or bill activated control panel, controlling the operation of the electrical units and indicating which units are available for use. Such a centralized panel could be conveniently provided with a change providing money acceptor device.

STATEMENT OF THE INVENTION

The invention comprises a central control panel to be used in association with a source of electric power, defining at least two power terminals including a high voltage terminal and a low voltage terminal, and a plurality of electrical units, each such unit including a unit controller device operable to control the functioning of the unit upon delivery of an electrical signal to the unit controller device, wherein the control panel comprises a power input means connectable to a first power terminal of the power source, a plurality of electrical switch means, each such switch means defining two normally closed switches and a normally open switch, each switch defining two terminals, the three switches being ganged together for simultaneous operation, one of the nromally closed switches of each switch means being connected in a first series to each other and to the power input means, another of the normally closed switches of each switch means being connected in a second series with each other, a first terminal of each normally open switch being connected to an electrical unit, a second terminal of each normally open switch being connected with a terminal of the said other normally closed switch within the same switch means, and, a control relay means, including an energizing circuit and a normally open relay switch, the energizing circuit being connected in series to the normally closed switch of a last switch means in the said first series, the energizing circuit being connectable to the second power terminal of the power source, whereby a voltage difference may be defined across the energizing circuit, the relay switch being connectable between the second power terminal of the power source and the normally closed switch of the first switch means in the said second series.

The advantages of the invention include the following: A central control panel is provided, controlling the operation of the electrical units. A single money acceptor device may be included on the control panel, thereby replacing the coin acceptors on the individual units. The cost of the distribution system is reduced accordingly and the reliability increased. Indicators may be provided on the control panel for showing which units are already in use. The money acceptor may conveniently be one that is able to provide change.

Accordingly, it is an object of the invention to provide a centralized, automatic control panel, controlling the operation of the electrical units and indicating which units are available for use.

In a specific embodiment of the invention, the electrical units are washing and drying machines, as may be found in a laundromat.

The various features of novelty which characterize the invention are pointed out with particularity in the claims annexed to and forming a part of this disclosure.

For a better understanding of the invention, its operating advantages and specific objects attained by its use, reference whould be had to the accompanying drawings and descriptive matter in which there are illustrated and described preferred embodiments of the invention.

IN THE DRAWINGS

DESCRIPTION OF A SPECIFIC EMBODIMENT

Figure 1:
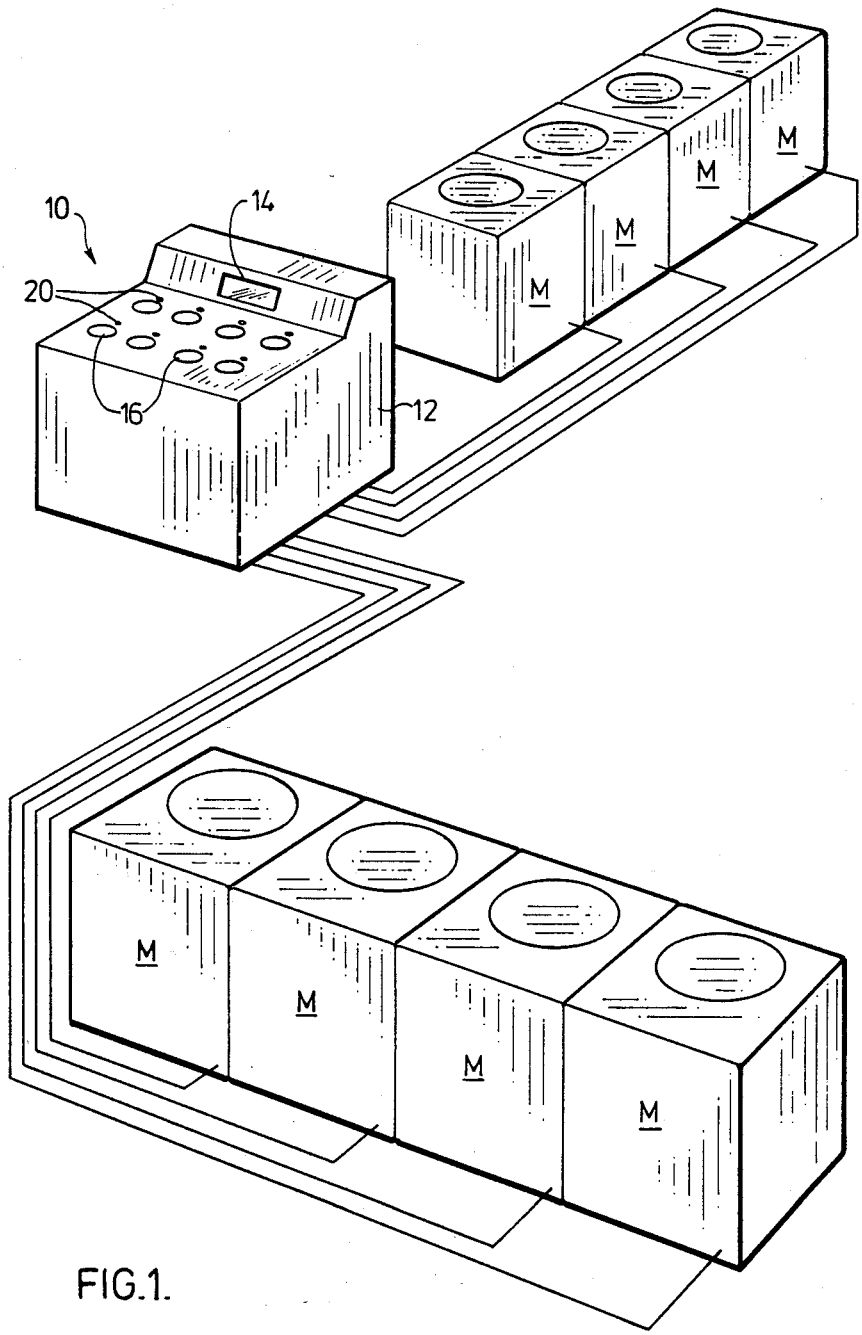
FIG. 1 is a schematic perspective view of one embodiment of a control panel according to the invention, shown connected to a multiplicity of electrical machines.
Figure 4:
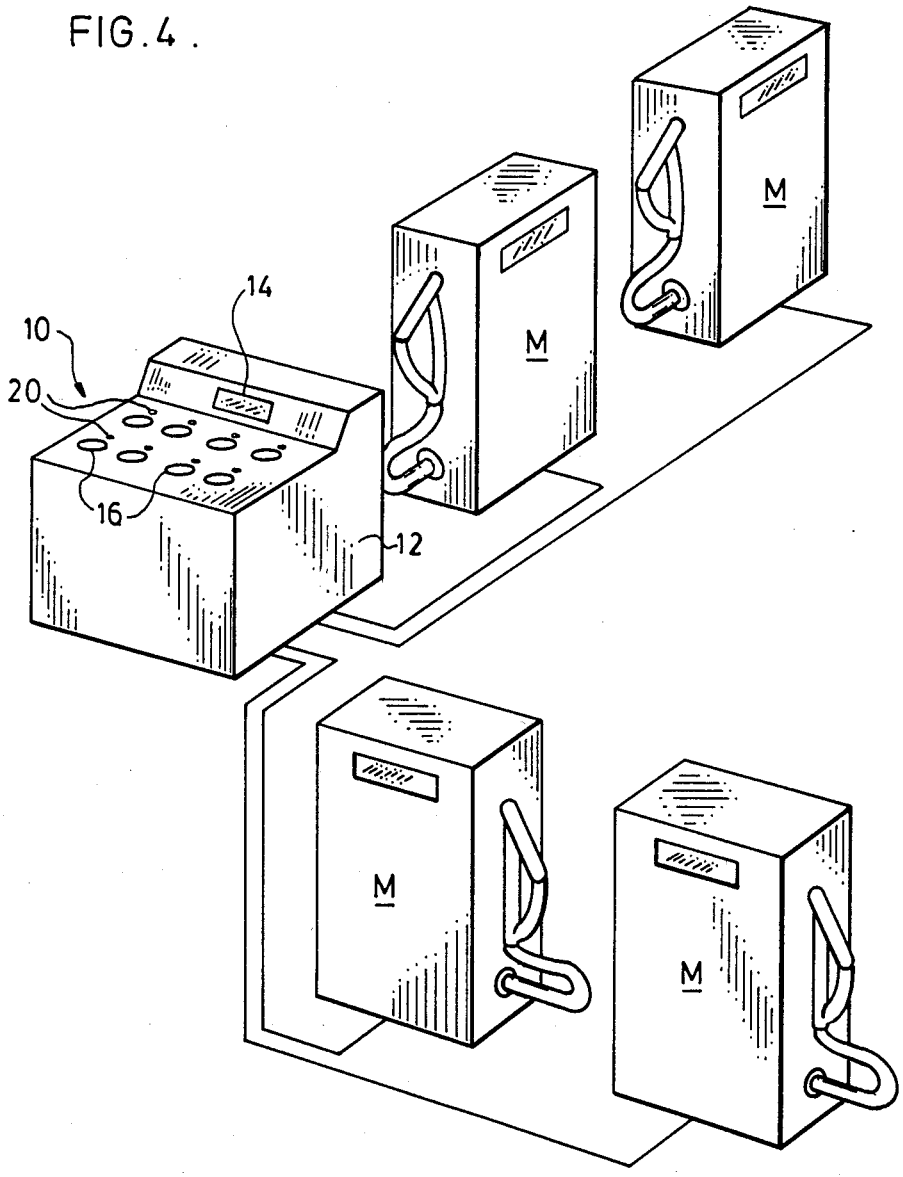

Referring to FIGS. 1 and 4, there are illustrated a group of electrical machines M, which may be washing machines and drying machines, as may typically be found in a laundromat or gasoline pumps in a gas station. Machines M are electrically connected to a central control panel according to the invention, indicated generally as 10. Each machine M is provided with a controller or timer device (not shown) operable to regulate the actual function of the machine through its various operational phases upon receipt of a suitable electrical signal. The machines M are also provided with suitable prime movers (not shown), such as electric motors. Finally, each machine M is connected to a suitable power source (not shown), for driving the prime mover or for the other specific purposes of the particular machine. Typically, such a power source provides a line signal, a neutral signal and a ground through respective terminals L, N and G.

It will be appreciated that the invention may be used to control the operation of any group of electrical or electronic machines. Washing and drying machines have been described in order to illustrate the operation of and facilitate understanding of one embodiment of the invention. It is not intended that the scope of the invention be restricted to its application with such washing and drying machines. Rather, it is intended that such scope include all applications of the invention to control the operation of any group of electrical or electronic machines.

Control panel 10 comprises enclosure 12 to which are fitted coin acceptor assembly 14 and push buttons 16. As described below, coin acceptor 14 is electrically connected to electrical circuitry, indicated generally as 18, which includes push buttons 16. Each of push buttons 16 is electrically associated with one of the machines M. Also electrically associated with each individual machine M and its respective push button 16 is a light bulb 20.

It will be appreciated that a bill acceptor may be used in place of coin acceptor 14. Conceivably, an acceptor adaptable to accept both bills and coins may also be used. Also, a suitable acceptor may be provided to deliver change to a customer, if required.

Machines M may be labelled or numbered for convenient identification. Push buttons 16 and light bulbs 20 may also be labelled or numbered in corresponding fashion, whereby a single push button 16 and bulb 20 are identified as associated with a particular machine M.

Coin acceptor 14 and all the above described electrical components, except circuitry 18, are all standard components, well known in the art.

Figure 2:
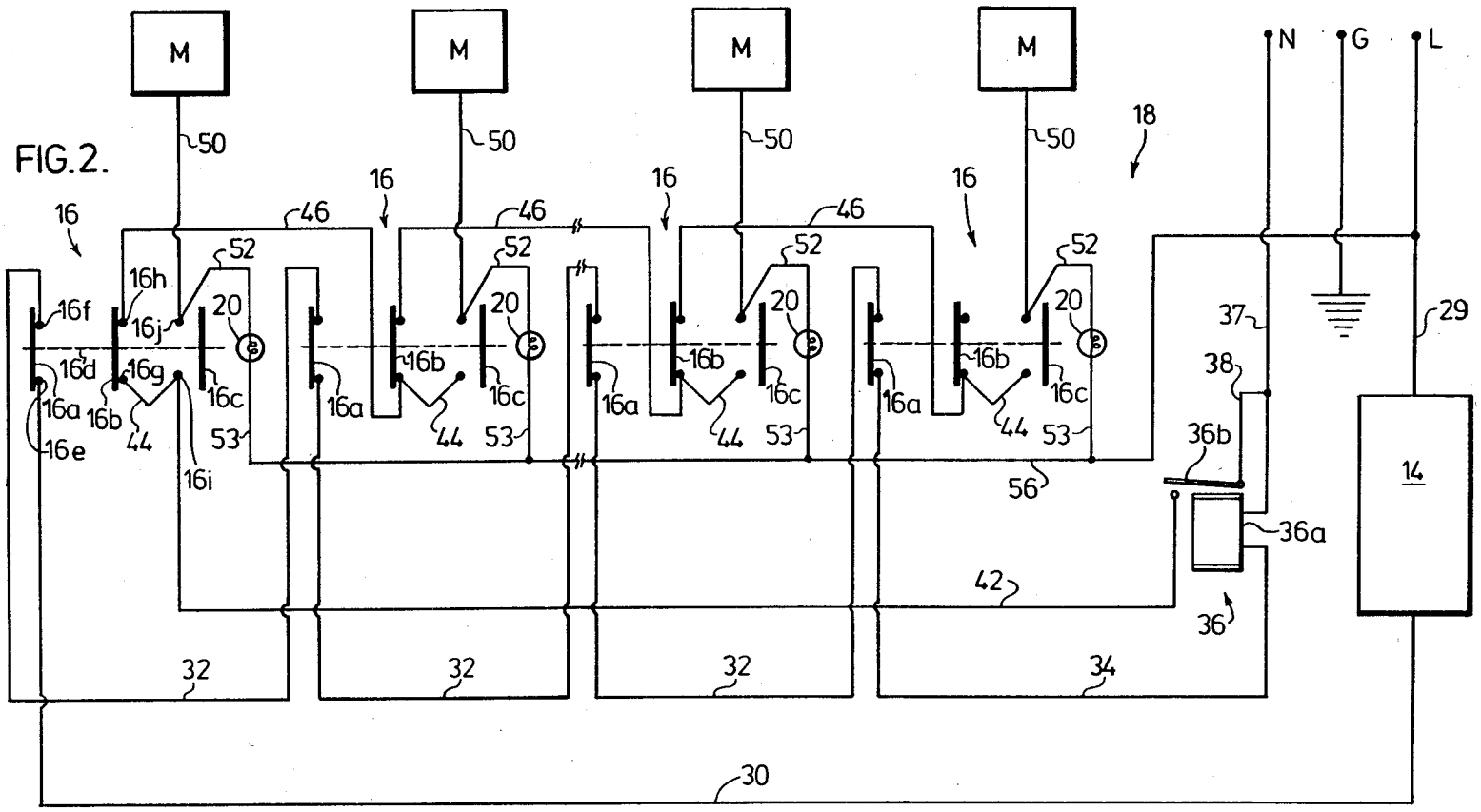
FIG. 2 is a wiring diagram, illustrating the circuitry of the control panel of FIG. 1.

Referring to FIG. 2, coin acceptor 14 is shown connected to machines M by circuitry 18, which includes push buttons 16.

Coin acceptor 14 is connected by line 29 to terminal L of a suitable power source (not shown), whereby the power source is operable to deliver a line signal to coin acceptor 14. Input line 30 is connected between coin acceptor 14, and a first push button 16 whereby when proper coins are inserted into coin acceptor 14, acceptor 14 will pass a line signal from the power source to line 30 to a first push button 16.

Each push button 16 comprises two normally closed switches, **16*a* and 16*b*, and one normally open switch 16*c*, ganged to shaft 16*d*. Suitable biasing means (not shown), such as a spring, hold switches 16*a*, 16*b*, and 16*c* and shaft 16*d* in the normal position of push button 16. Switch 16*a* defines two terminals 16*e* and 16*f*. Similarly, switch 16*b* defines terminals 16*g* and 16*h* and switch 16*c* defines terminals 16*i* and 16*j***.

Input line 30 is connected to terminal **16*e* of first push button 16**.

Terminal **16*f* is connected to a first interconnecting line 32. Line 32, in turn, is connected with terminal 16*f* of a second push button 16**.

Terminal **16*e* of such second push button 16 is connected to a second interconnecting line 32. Such second line 32 in turn is similarly connected with a third push button 16. A sufficient number of interconnecting lines 32 and push buttons 16** are provided and connected in series as described to correspond to the number of machines M.

Terminal **16*e* of a last push button 16 is connected to relay line 34, which in turn is connected to the energizing circuit 36*a* of relay 36. Relay 36** is a standard component, well known in the art.

The energizing circuit **36*a* of relay 36 is also connected to neutral input line 37. Input line 37 in turn is connected to terminal N of the power source (not shown), whereby the power source is operable to deliver a neutral signal to input line 37 and relay 36. Input line 37 is connected to line 38, which in turn is connected to normally open relay switch 36*b* of relay 36**.

Relay switch **36*b* in turn is connected to line 42 which connects with terminal 16*i* of first push button 16. Terminal 16*i* connects via jumper line 44 to terminal 16*g*. Terminal 16*h* of second push button 16 connects with a second interconnect line 46. Second interconnect line 46 connects in similar fashion with a following push button 16. Sufficient interconnect lines 46 are provided to connect all push buttons 16** in series, as described above.

A jumper line 44 connects between terminals **16*g* and 16*i* of each push button 16**.

Terminal **16*j* of each push button 16 connects to an output line 50, which in turn connects with a controller or timer device (not shown) in a machine M. The connection of line 50 to machine M is made whereby a signal delivered by line 50 to machine M may initiate operation of machine M. Furthermore, during operation line 50 delivers a corresponding signal from machine M to terminal 16*j***.

Terminal **16*j* of each push button 16 also connects to an indicator line 52. A light bulb 20 is connected to each indicator line 52. Bulb 20 also connects to line 53, which in turn connects to indicator bus 56. Indicator bus 56 is connected to line 29** whereby it may receive the line signal from terminal L of the power source.

In operation, the user inserts coins into coin acceptor 14 at the central control panel 10. If sufficient coinage is so inserted, coin acceptor 14 passes a line signal to line 30. Line signal will be passed through normally closed switches 16*a* and lines 32 to energize all push buttons 16. Line 34 is also energized and line signal passes to the energizing circuit 36*a* of relay 36. Neutral signal is also passed to line 38 and to the energizing circuit 36*a* of relay 36. When both the neutral signal and the line signal are present at the energizing circuit 36*a* of relay 36, relay 36 trips. Energizing circuit 36*a* causes normally open relay switch 36*b* to close. As relay switch 36*b* closes, the neutral signal in line 38, which previously had been unable to pass normally open relay switch 36*b*, passes the now closed switch 36*b* to energize line 42 and jumper line 44.

The neutral signal passes through normally closed switches 16*b* of push buttons 16 to energize all interconnect lines 46 and 48 and push buttons 16.

Thus, assuming that proper coins are inserted into coin acceptor 14, each push button 16 is energized. The user must then select a particular machine M. Light bulb 20 indicates, as described below, whether a machine M is in use. Thus, the user may select any machine M, for which the associated light bulb 20 is not illuminated. Having selected a machine M and having loaded the machine M with clothes, or otherwise prepared it for use, its associated push button 16 is pushed.

The neutral signal is passed through the normally open, but now closed, push button switch 16*c* to the desired machine M. The neutral signal is passed to the chosen machine M via output line 50. Such neutral signal commences a timer or other control devices (not shown) contained in the controller or timer device (not shown) of the machine M. The subsequent operation of the machine M is controlled by the controller or timer device (not shown) in it.

Meanwhile, as push button 16 is pushed, the normally closed push button switch 16*a* is opened. Thus, the line signal passing from coin acceptor 14 through push buttons 16 to relay 36 is interrupted. Such interruption causes relay 36 to reset. Energizing circuit 36*a* is de-energized and relay switch 36*b* is re-opened. The opening of switch 36*b* interrupts neutral signal to push buttons 16. Thus, push buttons 16 are de-energized. In this fashion, the operation of additional machines M by the pushing of additional push buttons 16, is prevented. To operate additional machines, additional coins must be inserted into coin acceptor 14 to re-energize push buttons 16.

When an energized push button 16 is pushed, normally open switch 16*c* is closed and delivers a neutral signal to light bulb 20 through indicator line 52. Line signal is also present at light bulb 20 through line 53 and indicator bus 56. When both neutral signal and line signal are present at light bulb 20, light bulb 20 will be illuminated. Thus, as energized push button 16 is depressed, light bulb 20 will be illuminated, thus indicating that the selected machine M is now in use.

Once a machine M has commenced operation, its controller or timer device (not shown) will deliver a neutral signal from the power source of the machine M to output line 50. Output line 50 will pass such neutral signal back through terminal 16*j* of push button 16 to indicator line 52 and to light bulb 20. Thus, when push button 16 is released, light bulb 20 will continue to be illuminated during the operation of machine M. When the operative cycle of the machine M is completed under the control of its controller or timer device (not shown), the controller or timer device will interrupt the neutral signal to output line 50. Thus, the neutral signal to indicator line 52 and light bulb 20 will be interrupted and light bulb 20 will be extinguished as machine M stops. Machine M may subsequently be re-used by another user.

In a further embodiment, some changes in wiring may be made without affecting the operation of the invention. For example, line 42 may be connected to terminal 16*g*. Lines 46 may be connected either to terminal 16*g*, as shown, or to terminal 16*i*. Other shop or engineering modifications of this nature may be made by a person skilled in the art without departing from the inventive principles disclosed herein.

Figure 3:
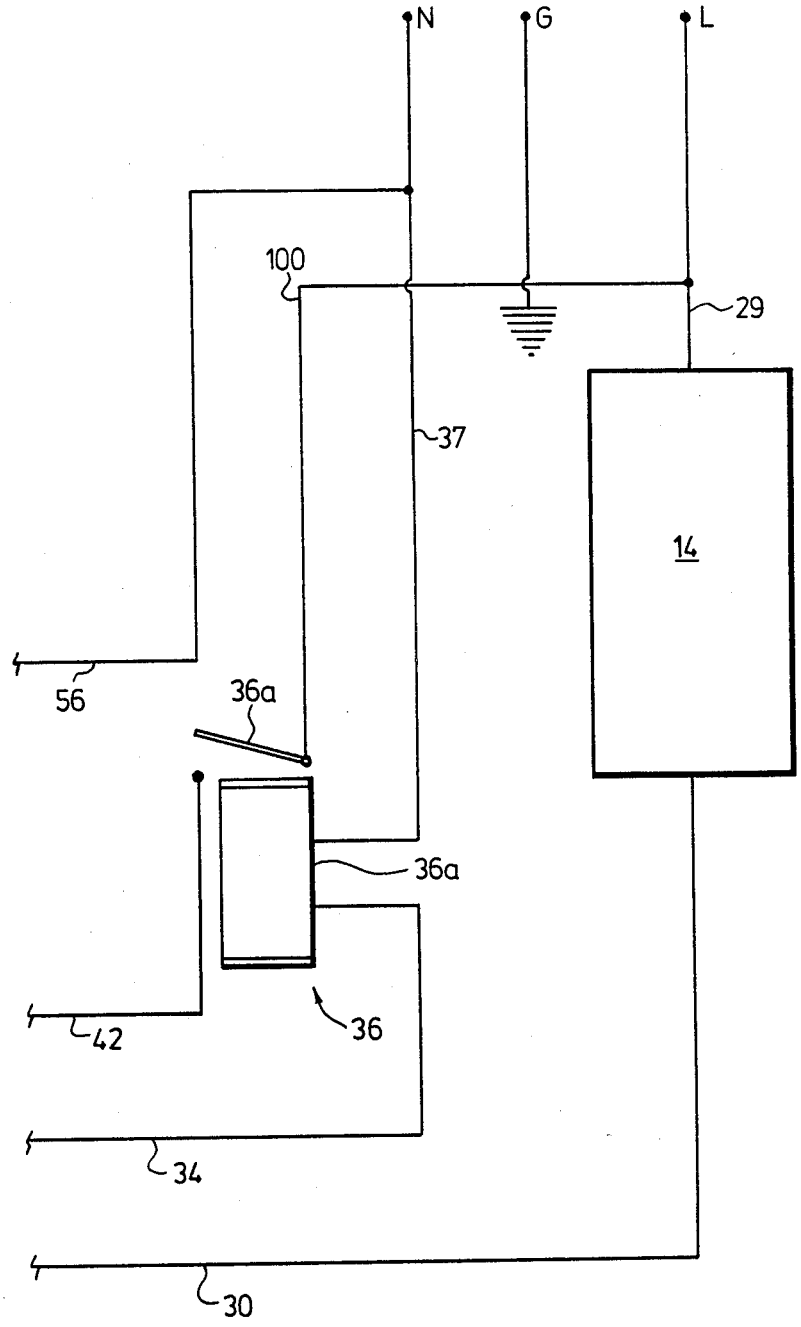
FIG. 3 is a wiring diagram of an alternate embodiment, corresponding to a portion of that of FIG. 2, and, FIG. 4 is a schematic view corresponding to FIG. 1 showing gasoline pump electrical machines.

In yet a further embodiment, it will be appreciated that circuitry 18 may be connected to the terminals N and L of the power source (not shown) in alternative fashion without departing from the inventive principles disclosed herein. Referring to FIG. 3, for example, line 38 can be replaced by line 100 connecting relay switch 36*b* to line 29. Indicator bus 56, in turn, is connected to line 37. Thus, a line signal energizes switches 16 and is delivered to machine M to initiate its operation. Once machine M has started operation machine M continues to deliver a line signal back to switch 16 and light bulb 20. Indicator bus 56 delivers a neutral signal to light bulb 20. Thus, bulb 20 will be illuminated.

In another embodiment, it may not be necessary to use a coin acceptor device to deliver a line signal to circuitry 18. Any power input device operable to deliver such a signal may be used in particular situations. For example, a simple switch adapted to return to an open position when relay 36 resets may be sufficient. Payment for use of the machines would have to be arranged in a different fashion.

In a further embodiment, it will be appreciated that circuitry 18 may be adapted to operate between a high and a low voltage (one of which may define a ground). Relay 36 and light bulb 20 may be adapted to operate between such high and low voltages.

It will be appreciated that in the illustrated embodiment, heavy duty electrical equipment has been used. However, the principles of the invention may be easily incorporated into an electronic control system, handling lower voltages. In such a case, the electronic system would operate suitable relay switches in lines providing power to machines M. The electronic control system would be powered by a suitable control circuit power means. Suitable relay means would be required between coin acceptor 14 and first switch 16, before both energizing circuit 16*a* and relay switch 36*b*, between machine M and its associated switch 16.

It will be appreciated that a machine M, as described above, is operable to commence operation upon receipt of a signal from line 50. Also, it is connected to line 50 and is operable whereby a corresponding signal may be delivered from machine M to line 50 during operation. It will be understood that such latter feature is required if it is desired to have a light bulb 20 or other machine-in-use indicator. If such a bulb 20 or other indicator is not desired, then it is not required that machine M deliver the said corresponding signal during operation.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A central control panel to be used in association with a source of electric power, defining at least two power terminals, and a plurality of electrical units, each such unit including a unit controller device operable to control the functioning of the unit upon delivery of a start signal to the unit controller device, the start signal being a signal from a pre-determined terminal of the power source, wherein the control panel comprises:

a power input means connectable to a first power terminal of the power source;

a plurality of electrical switch means, each such switch means defining two normally closed switches and a normally open switch, each switch defining two terminals, the three switches being ganged together for simultaneous operation, one of the normally closed switches of each switch means being connected in a first series to each corresponding normally closed switch and to the power input means, another of the normally closed switches of each switch means being connected in a second series with each corresponding another normally closed switch, a first terminal of each normally open switch being connected to an electrical unit controller device, a second terminal of each normally open switch being connected with a terminal of the said another normally closed switch within the same switch means, and, a control relay means, including an energizing circuit and a normally open relay switch, the energizing circuit being connected in series to the normally closed switch of a last switch means in the said first series, the energizing circuit being connectable to the second power terminal of the power source, whereby a voltage difference may be defined across the energizing circuit, the relay switch being connectable between the pre-determined terminal of the power source and the normally closed switch of the first switch means in the said second series.

2. A central control panel as claimed in claim 1, wherein the unit controller device is operable to deliver a signal from the pre-determined power terminal of the power source to the first terminal of the normally open switch during operation of the unit and including an indicator means connectable between the first terminal of the normally open switch and the other power terminal, whereby the indicator means is operable to indicate that its associated unit is in use.

3. A central control panel as claimed in claim 2, wherein the power input means comprises a money acceptor mechanism.

4. A central control panel as claimed in claim 3, wherein the electrical units are washing machines and drying machines.

5. A central control panel as claimed in claim 3, wherein the electrical units are gasoline pumps.

* * * * *